US009888735B2

(12) United States Patent
Zhu

(10) Patent No.: US 9,888,735 B2
(45) Date of Patent: Feb. 13, 2018

(54) CLOTHING AND CLOTHING ARTICLE

(71) Applicant: Xiaoyi Zhu, Guangdong (CN)

(72) Inventor: Xiaoyi Zhu, Guangdong (CN)

( * ) Notice: Subject to any disclaimer, the term of this patent is extended or adjusted under 35 U.S.C. 154(b) by 342 days.

(21) Appl. No.: 14/589,102

(22) Filed: Jan. 5, 2015

(65) Prior Publication Data

US 2016/0192723 A1 Jul. 7, 2016

(51) Int. Cl.
*A41D 31/00* (2006.01)
*A41D 31/02* (2006.01)

(52) U.S. Cl.
CPC ..... *A41D 31/02* (2013.01); *A41D 2400/62* (2013.01)

(58) Field of Classification Search
CPC A41B 2400/60; A41C 3/0085; A41D 13/002; A41D 13/005; A41D 13/0056; A41D 19/0079; A41D 2400/60; A42B 3/28; A42B 3/283
See application file for complete search history.

(56) References Cited

U.S. PATENT DOCUMENTS 4,451,934 A * 6/1984 Gioello ..... A41B 9/00 2/113
9,009,869 B1 * 4/2015 Shapiro ..... A41D 20/00 2/181
2004/0060095 A1 * 4/2004 Bradbury ..... A41D 19/0079 2/159

* cited by examiner

*Primary Examiner* — Khaled Annis
(74) *Attorney, Agent, or Firm* — Ladas & Parry LLP

(57) ABSTRACT

Provided is a clothing as well as a clothing article having a similar structure of the clothing, the clothing comprising a base layer (200) having an inner surface and an outer surface; the inner surface being substantially planar and forming a first fluid passage (400) with human skin (200); the outer surface being formed as a flow-disturbing face or the outer surface being attached with components having flow-disturbing face; the base layer being provided with at least one through opening (500), through which the first fluid passage being communicated with the flow-disturbing face. The clothing and the clothing article of the present invention is particularly suitable for sports.

10 Claims, 7 Drawing Sheets

CLOTHING AND CLOTHING ARTICLE

TECHNICAL FIELD

The present invention relates to the field of clothing, particular to sports clothing and clothing article.

PRIOR ART

Clothing for human being has been developed for thousands of years. At present, there has been a wide variety of clothing suitable for different occupations.

Clothing has a significant impact on some special fields. For example, in a competitive race of challenge to the limits of the human body, the fluid resistance occurred (luring movement can be reduced by designing the structure of clothing, which may have a decisive influence on the outcome of the race. Another example is about police's and military's clothing; in this respect, the clothing may play an important role on improving a police's or a soldier's moving speed at a crucial moment.

SUMMARY OF THE INVENTION

A clothing is provided in the present invention, comprising a base layer having an inner surface and an outer surface; the inner surface being substantially planar and forming a first fluid passage with human skin; the outer surface being formed as a flow-disturbing face or the outer surface being attached with components having flow-disturbing face; the base layer being provided with at least one through opening, through which the first fluid passage being communicating with the flow-disturbing face, so that a pressure difference being generated due to different flow rates between fluid flowed in the first fluid passage and fluid flowed on the flow-disturbing face.

The clothing disclosed in the present invention is particularly suitable for sports. With the clothing, the first fluid passage is formed between human skin and the inner surface of the clothing, since the path through which the fluid passed on the flow-disturbing face which is communicated with the first fluid passage and located at the outer surface is greater than the path through which the fluid passed within the corresponding fluid passage, the pressure difference is transferred by the fluid at a low-velocity and high-pressure area within the fluid passage to a high-velocity and low-pressure area via multiple through openings, consequently, a pressure difference transferring area is formed around human body during human movement, and a driving force generated by the pressure difference is able to transfer the fluid resistance partially outwards to reduce the fluid resistance, thus helping to enhance human's moving speed. Moreover, when in summer, under the pressure difference, human body heat can be dissipated rapidly to the outside of the clothing via the first fluid passage and the through openings to make people feel cooler, and such cooling way is better than an air conditioner in health and environmental protection.

REFERENCE NUMERAL LIST

Figure 1:
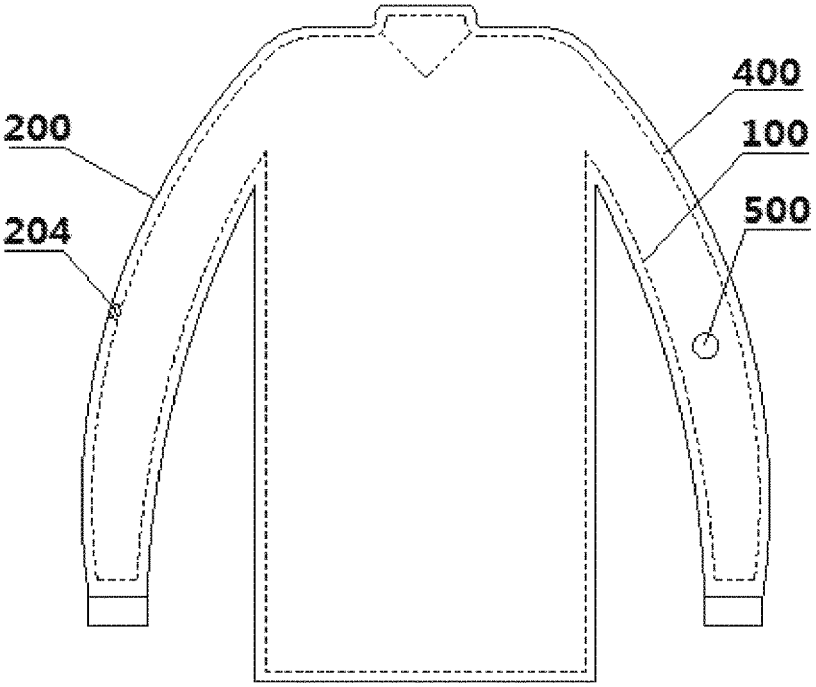
FIG. 1 is a schematic view of an upper outer garment according to the clothing of an embodiment of the present invention.

100 skin
200 base layer
201 outer surface of base layer
202 inner surface of base layer
203 connecting piece
204 supporting pad
300 flow-disturbing face
301 concave-convex shape
302 component having flow-disturbing face
303 fish-scale flow disturbing piece
304 feather-like flow disturbing piece
341 trunk of feather-like flow disturbing piece
342 branch of feather-like flow disturbing piece
343 sub-branch of feather-like flow disturbing piece
400 first fluid passage
401 second fluid passage
500 through opening

DETAILED DESCRIPTIONS

The technical content, structural features, purposes and effects of the present invention are described in detail in the following embodiments with the accompanying drawings.

The present invention is intended to introduce the concept of pressure difference into clothing design, especially for sportswear design, so as to decrease the fluid resistance occurred during human movement and increase human's moving speed.

Figure 2:
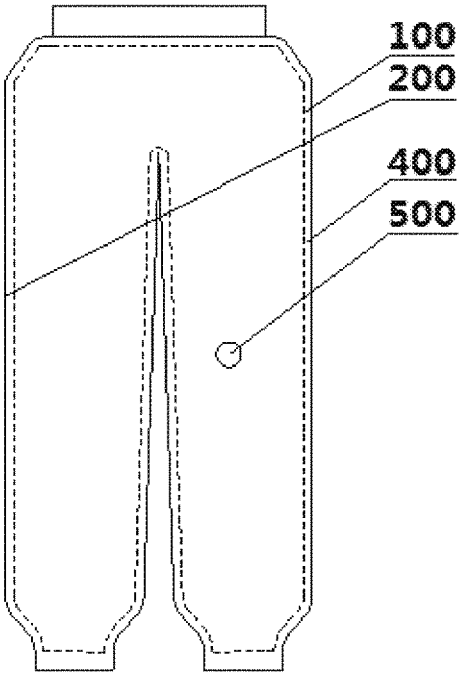
FIG. 2 is a schematic view of a pair of trousers according to the clothing of an embodiment of the present invention.
Figure 3:
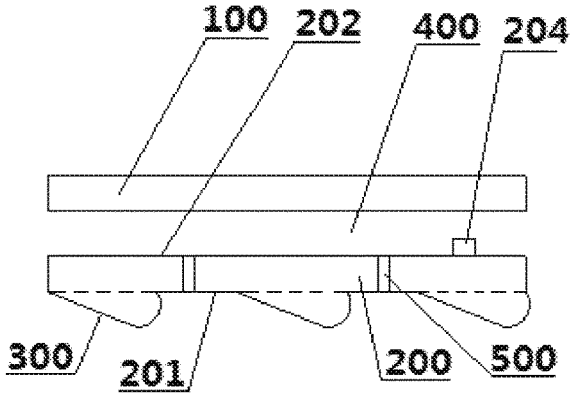
FIG. 3 is a schematic view of a local structure of the clothing according to an embodiment of the present invention.

FIGS. 1-3 show the clothing comprising an upper outer garment and a pair of trousers according to an embodiment of the present invention. The structure of the clothing comprises a base layer 200 having an inner surface 202 and an outer surface 201. The inner surface is substantially planar with a size slightly larger than the human body wearing the clothing. A first fluid passage 400 is formed between the inner surface and human skin 100. The outer surface 201 is provided with a flow-disturbing face 300 thereon. The flow-disturbing face can be formed by the outer surface, that is, a concave-convex shape forming the flow-disturbing face is integrated with the base layer. The flow-disturbing face can be formed by a component having flow-disturbing face, and the component is additionally attached to the base layer. Therefore, as shown in FIG. 3, the portion having flow-disturbing face and the base layer are separated by a dotted line. The base layer is provided with at least one through opening 500; for the sake of example, there is only one through opening depicted in FIG. 1 and FIG. 2; however, in a practical application, a plurality of through openings can be arranged on the base layer, for example in a uniform or non-uniform arrangement. The through openings can be arranged on the respective portion which forms the flow-disturbing face or be arranged between the portions which form the flow-disturbing face. The first fluid passage is communicated with the flow-disturbing face via these through openings. For an instance, referring to FIG. 3, the through openings are arranged between the arc-shaped projections which form the flow-disturbing face.

When a person wearing the clothing of the present invention moves, a fluid (e.g. air or water) is entered into the first fluid passage 400 which is substantially planar via a plurality of through openings 500; but at the outer surface of the clothing, the path through which the fluid passed is elongated by the flow-disturbing face, which is greater than the path within the corresponding fluid passage. Therefore, the fluid flowed in the first fluid passage is low in flow rate and high in atmospheric pressure, while the fluid flowed on the corresponding flow-disturbing face is high in flow rate and low in atmospheric pressure. A pressure difference generated between fluid flowed inside and fluid flowed outside due to different flow rates is transferred from within via the through openings 500, thus a driving force is generated, by which a pressure difference transferring area around human body is formed to partially transfer outwards the fluid resistance occurred during movement, so that human's moving speed is increased.

The greater the difference between the path through which the fluid passed the flow-disturbing face 300 and the path through which the fluid passed the first fluid passage 400, the greater the pressure difference generated; furthermore, the faster the human's moving speed, the greater the pressure difference generated as well. With a design in making difference between the fluid path at the flow-disturbing face and the fluid path in the first fluid passage, a desired pressure difference is generated.

Preferably, a supporting pad 404 is provided between the inner surface 202 of the base layer and human skin 100. The supporting pad is connected to the inner surface of the base layer. Generally a fluid passage is formed spontaneously between skin and the inner surface without a support pad. However, human skin is likely to adhere to the inner surface when people swim or sweat, so a supporting pad is able to better support the first fluid passage to ensure a smooth fluid passage. The face where the supporting pad contacted with skin is preferably an arc-shaped face adapted with the surface of human skin. The supporting pad is preferably made from soft material with good biocompatibility. In some applications, the width of the first fluid passage is set by adjusting the thickness of the supporting pad, thus adjusting the pressure difference between the inner and outer surfaces.

Figure 4A:
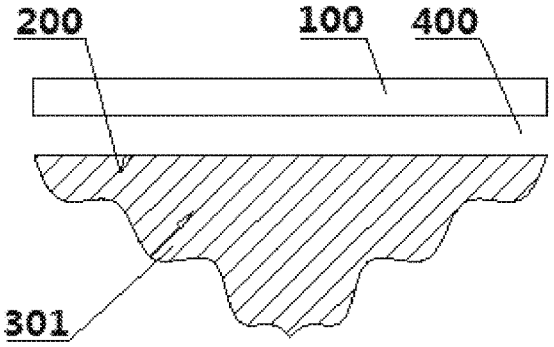
FIGS. 4A~4E are schematic views of different concave-convex shapes according to the clothing of embodiments of the present invention.
Figure 4B:
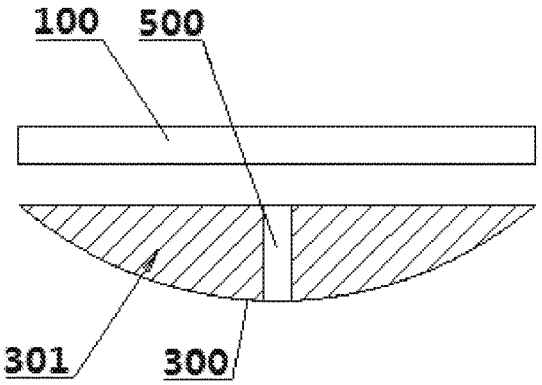
Figure 4C:
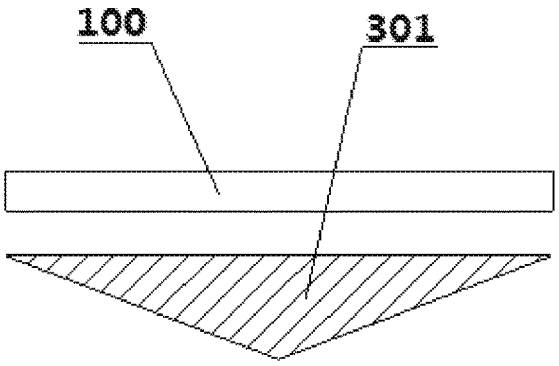
Figure 4D:
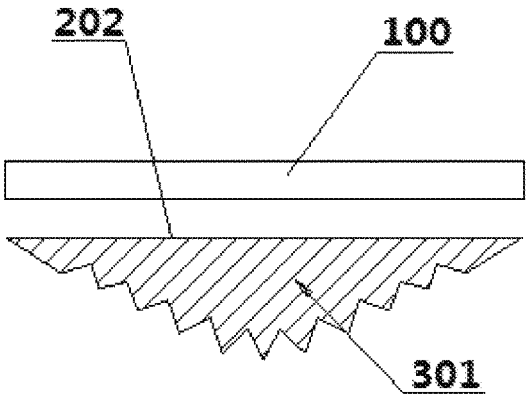
Figure 4E:
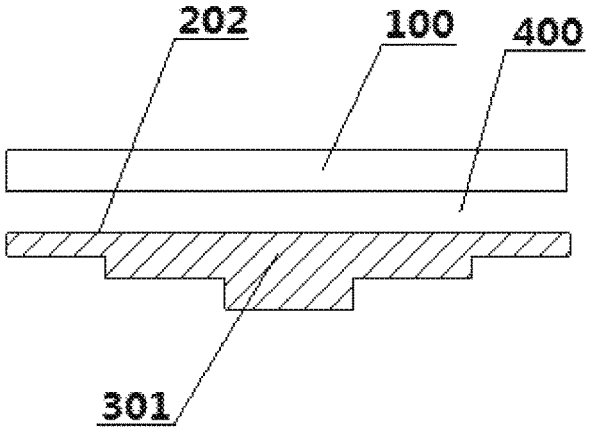

As mentioned above, with reference to FIGS. 4A-4E, in some embodiments, the base layer has a concave-convex shape (301) on a side of the outer surface, so that the outer surface is formed as a flow-disturbing face. The concave-convex shape forming the flow-disturbing face can be one or more shapes selected from a group consisting of arc, triangle, zigzag, trapezoid, polygon and bar. For example, the concave-convex shape which forms the flow-disturbing face shown in FIG. 4A includes several continuous arcs. For another example, the concave-convex shape which forms the flow-disturbing face shown in FIG. 4B is one arc, and the through opening 500 is arranged at the raised position of the arc. For another example, the concave-convex shape which forms the flow-disturbing face shown in FIG. 4C is a triangle. For another example, the concave-convex shape which forms the flow-disturbing face shown in FIG. 4D) is zigzag. For another example, the concave-convex shape which forms the flow-disturbing face shown in FIG. 4E is trapezoid. Although example shapes are provided above, one skilled in the art can also adopt other shapes for the concave-convex structure to form the flow-disturbing face.

These concave-convex shapes are arranged at a side of the outer surface in a uniform or non-uniform manner. Moreover, they can be distributed along longitudinal direction and lateral direction as well. The area covered by the flow-disturbing face can be a part of the outer surface of the clothing or the whole outer surface. A single concave-convex shape can be used to form all desired flow-disturbing faces, but two or more different shapes can also be adopted.

Preferably, these concave-convex shapes are arranged into one or more rows in a uniform or non-uniform manner along longitudinal direction or lateral direction, thus forming a flow-disturbing face as a whole similar to the surface of water wave. The clothing made with wavy flow-disturbing flow is especially suitable for swimmers and divers to reduce fluid resistance in an even better fashion.

As mentioned above, referring to FIG. 5 and FIG. 6, in some embodiments, a desired flow-disturbing face is formed by attaching components 302 having flow-disturbing face to the outer surface 201. The components 302 having flow-disturbing face are preferably attached to the outer surface via a connecting piece 203. The flexible or fixed connection between the connecting piece and the outer surface allows the flow-disturbing face of the component to cover the outer surface. A plurality of components can be arranged in one or more rows which are contacted with each other or partially overlapped, so as to cover the whole or a part of the outer surface of the base layer.

Figure 5:
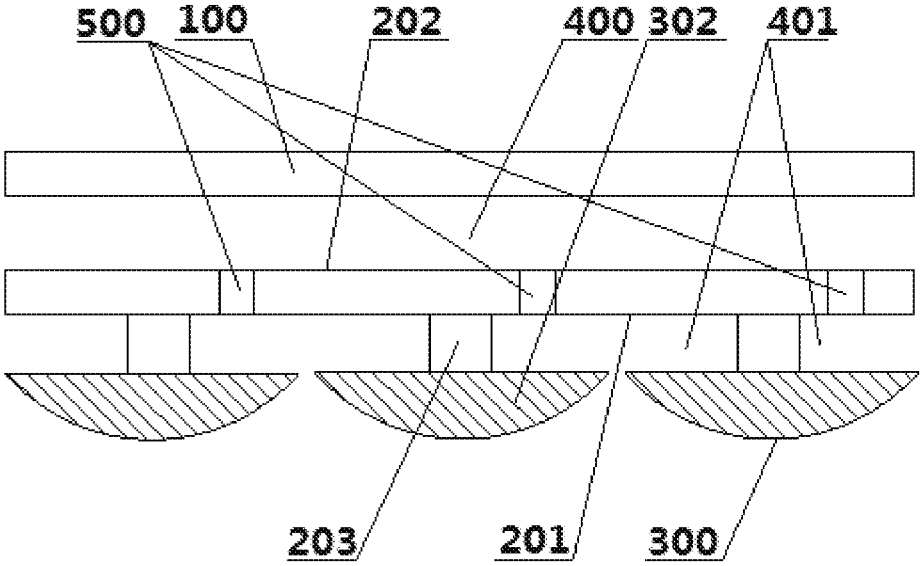
FIG. 5 is a schematic view of another local structure of the clothing according to an embodiment of the present invention.
Figure 8:
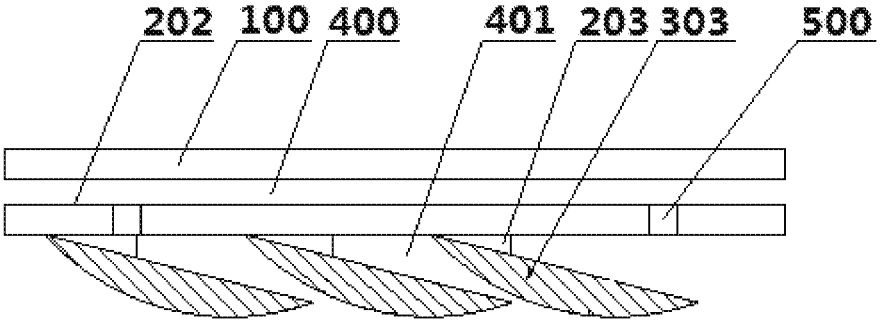
FIG. 8 is a schematic view of another local structure of the clothing according to an embodiment of the present invention.

Preferably, the through opening 500 is provided at a part of the outer surface where the part is covered by the flow-disturbing face of the component, and the through opening is stayed away from the position where the connecting piece is connected to the outer surface. A second fluid passage 401 is formed between the component and the outer surface, through which the first fluid passage 400 is communicated with the flow-disturbing face of the component via the through opening. As shown in FIG. 5, there is no overlap between the components, and the second fluid passage is communicated with the flow-disturbing face of the surface of the component through the gap between the components. In other embodiments, the components may be partially overlapped with each other, for example, as shown in FIG. 8, the second fluid passage can be extended to the gaps forming by the parts where the components overlapped with each other, and is communicated with the flow-disturbing face on the surface of the component via the gaps.

The second fluid passage is able to help to transfer the pressure difference between the first fluid passage and the flow-disturbing face in a better way to reduce fluid resistance. In some applications, the width and the angle of the second fluid passage can be controlled by adjusting the height and the inclined angle of the connecting piece, so as to adjust the pressure difference between the outer and inner surfaces.

Figure 6:
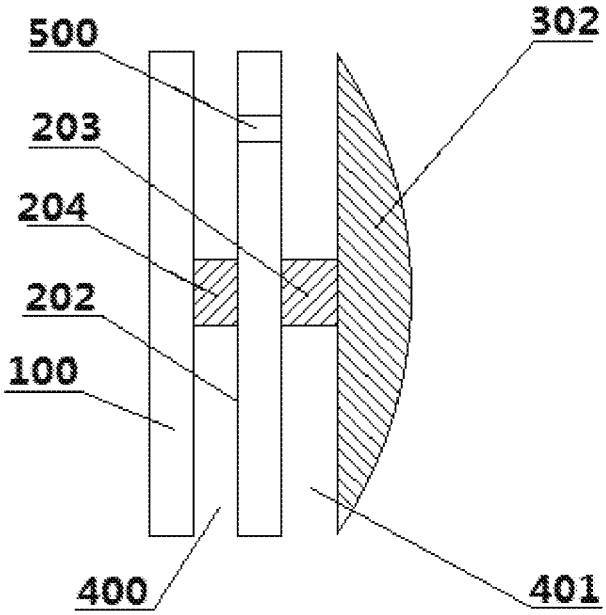
FIG. 6 is a schematic view of another local structure of the clothing according to an embodiment of the present invention.

Furthermore, referring to FIG. 6, a supporting pad 204 is preferably provided between the inner surface 202 of the base layer and human skin 100. In this respect, the connecting piece 203 can be fixed through the base layer and the supporting pad, or a part of the connecting piece is regarded as the supporting pad wherein the part is passes through the base layer and its inner surface come out. The component can be designed with various shapes to form a desired flow-disturbing face, for example, the component can have a concave-convex shape shown in FIGS. 4A-4E.

Figure 7:
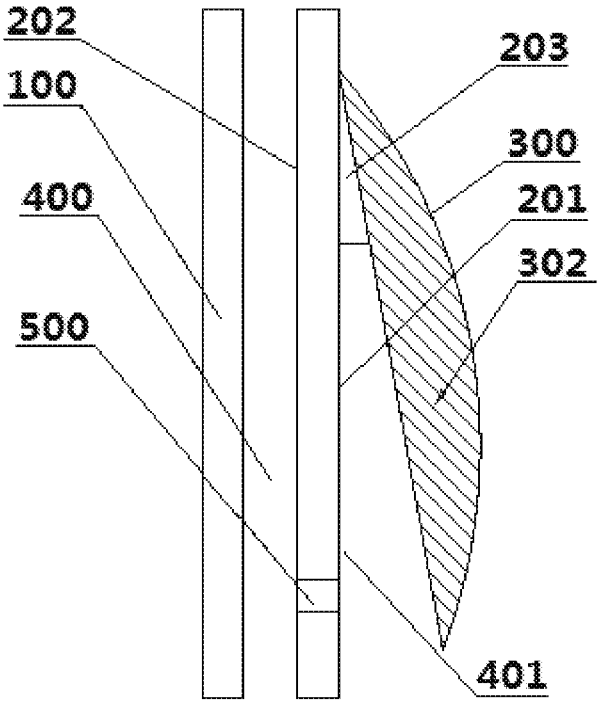
FIG. 7 is a schematic view of another local structure of the clothing according to an embodiment of the present invention.

In an embodiment, referring to FIG. 7, a component 302 having an arc-shaped flow-disturbing face is adopted, wherein the radian of the inner surface thereof is smaller than that of the outer surface. One end of the component is fixed to the outer surface of the base layer via a triangle connecting piece 203; the arc-shaped flow-disturbing face of the component is covered the outer surface of the base layer with a certain gap, and the gap is formed as the second fluid passage 400 which is communicated with the first fluid passage 400 via the through opening 500. Preferably, a material which can be controlled through mechanical or optoelectronic means is provided in the connecting piece, such as elastic or magnetic material, to is control the thickness and the angle of the connecting piece, so that athletes wearing the clothing can adjust the state of the flow-disturbing face based on their own needs to achieve better result.

Figure 9:
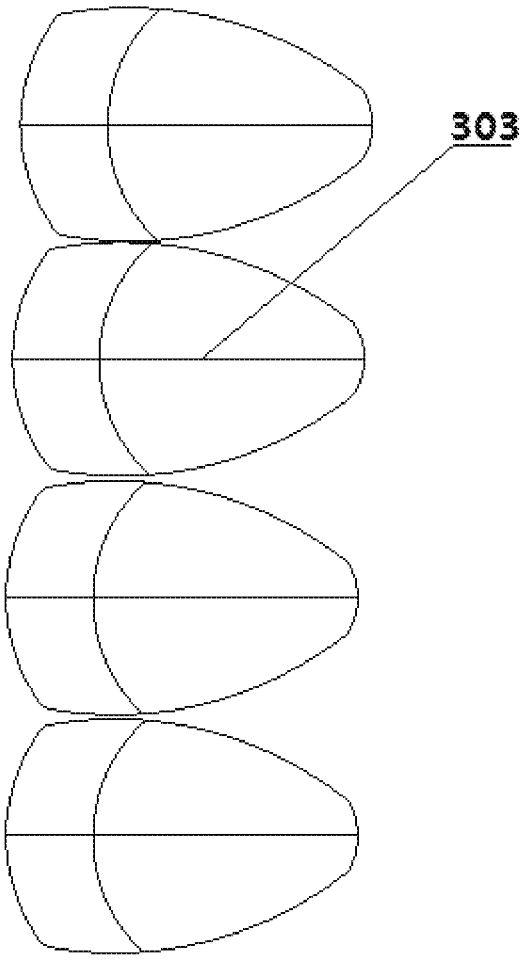
FIG. 9 is a schematic view of the fish-scale flow disturbing piece shown in FIG. 8.

In an embodiment, with reference to FIG. 8 and FIG. 9, a fish-scale flow disturbing piece 303 is used as the component. In this embodiment, the fixed way of the component is similar to that shown in FIG. 7, which will not be repeated here. Referring to FIG. 9, the forepart of the fish-scale flow disturbing piece is smaller than the rear thereof, the middle part of the outer surface thereof is protruded and smoothly extended downward to both sides to form a carved face as the flow-disturbing face, the radian of the outer surface thereof is larger than that of the inner surface, and the path through which the fluid passed at the outer surface of the flow-disturbing piece is larger than the path through which the fluid passed at the inner surface of the flow-disturbing piece. A plurality of the fish-scale flow disturbing pieces can be connected into one or more rows and arranged at the outer surface of the clothing from bottom to up and left to right. As shown in FIG. 8, such sequentially arranged flow disturbing pieces may partially overlap with each other and form a structure of covering layer by layer, thus enabling to better transfer the pressure difference from high pressure to low pressure layer by layer to reduce more fluid resistance.

Figure 10:
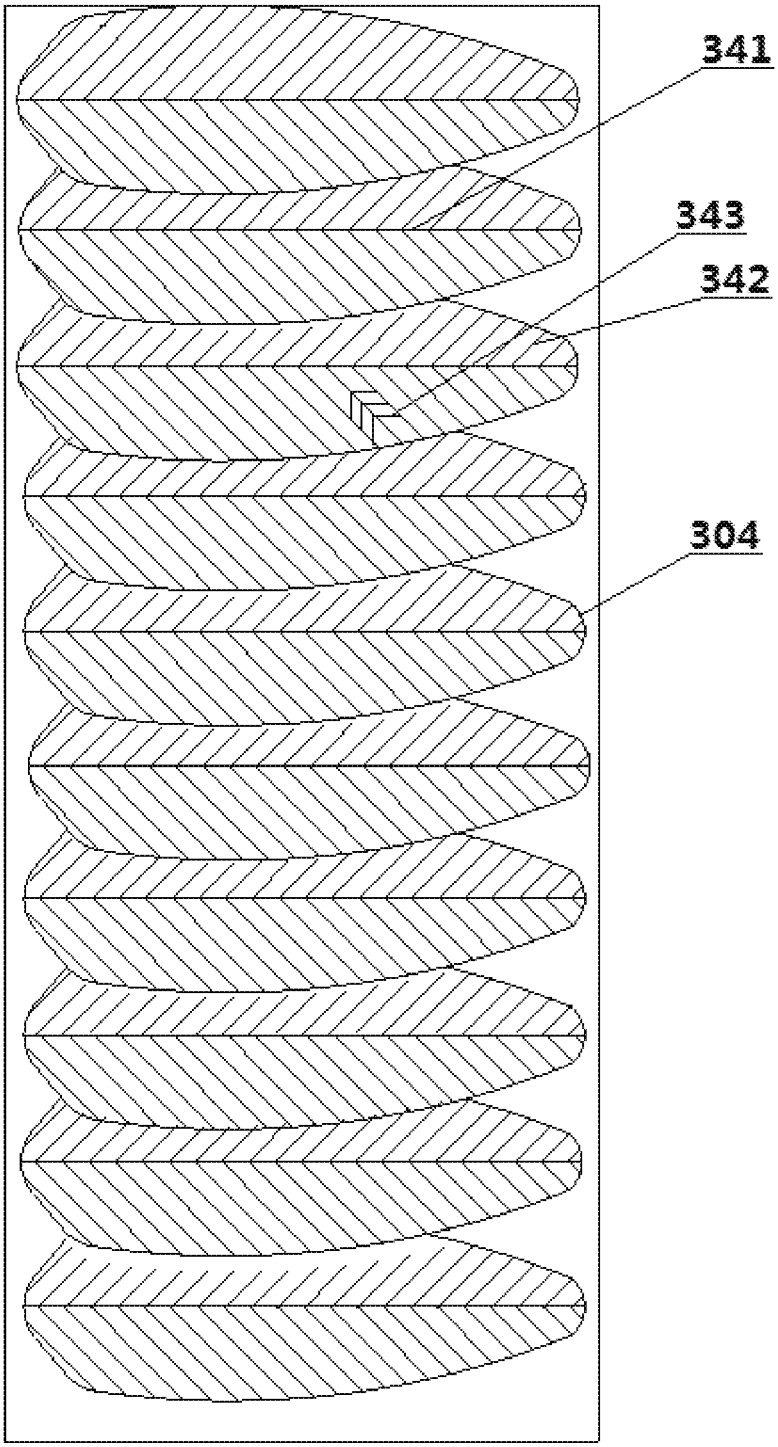
FIG. 10 is a schematic view of the feather-like flow disturbing piece of the clothing according to an embodiment of the present invention.

In an embodiment, referring to FIG. 10, a feather-like flow disturbing pieces 304, which may be used in place of the fish-scale flow disturbing piece shown in FIG. 8, is adopted as the component. The feather-like flow disturbing piece may have a structure imitating a bird's feather. Each feather-like flow disturbing piece has a trunk 341 and several limbs smoothly extended downward along both sides of the backbone, each limb has a branch 342 and several sub-branches 343 extended downward along both sides of the branch, the middle part of each sub-branch is protruded and smoothly extended downward to both sides to form a carved face, the entire outer surface of the feather-like flow disturbing piece is formed as a flow-disturbing face, the radian of the outer surface thereof is larger than that of the inner surface. For simplicity, only a few sub-branches of one branch are schematically depicted in FIG. 10, the sub-branches can be applied to all branches, moreover, if higher manufacture is allowed, a further lower level of sub-branch may be provided at the sub-branches.

The special shape of the feather-like flow disturbing piece greatly elongates the path the fluid passed through the flow disturbing face. Every feather or every row of feathers can be partially overlapped in a manner shown in FIG. 8 and forms a structure of covering layer by layer. The flow-disturbing face formed by the feather-like flow disturbing piece has a special stacked path for fluid to flow through, and the fluid path is gradually enlarged layer by layer via the trunk, branch and sub-branches, which makes it better to generate and transfer the pressure difference to reduce the fluid resistance occurred during movement. Such structure of flow-disturbing face is particularly suitable for sports events, such as long or short runs, high jump, long jump, basketball and football games, and whether the feather-like flow disturbing pieces is arranged on a part of or all of the clothing may be depended on the requirement, for example, disposing one or more layers of feather-like flow disturbing pieces on the arm portion of the clothing.

The structure of the clothing according to the present invention can also be applied in other clothing articles, for example, a headgear or footwear. Various forms of flow disturbing can be set at the surface of these clothing articles and communicated with the inner first fluid passage via the through openings on the surface, thus forming a pressure difference transferring area from within, so that the resistance occurred during exercise can be reduced when wearing such a clothing article.

In summary, according to the sportswear provided by the present invention, the concept of pressure difference is introduced into the design of the clothing, and the flow resistance acting on human body can be reduced by the clothing mentioned above, especially when the sportswear adopts the design of the present invention, the flow resistance acting on human body can be greatly reduced and the performance of the athlete who wears such clothing can be improved.

The description mentioned above serves only as embodiments of the present invention, and not to limit the protection scope of the present invention, therefore, the equivalents using the contents of the description and the drawings, or the applications directly or indirectly used in the related technical field, are included in the patentable scope of the present invention.

The invention claimed is:

1. A clothing, comprising a base layer having an inner surface and an outer surface; the inner surface being substantially planar and forming a first fluid passage with human skin; further comprising a supporting pad being arranged at the inner surface so that a width of the first fluid passage between the skin and the inner surface of the clothing is maintained when the clothing is worn;

the outer surface having components having a flow-disturbing face attached thereto, the base layer being provided with through openings, passing through the base layer by extending from the inner surface to the outer surface and through which the first fluid passage is connected with the flow-disturbing face, thereby providing a first path through which a fluid passed that is lengthened by the flow-disturbing face, and greater than a second path which is defined by the corresponding first fluid passage; so that a pressure difference is generated due to different flow rates between fluid flowing in the first fluid passage and fluid flowing on the flow-disturbing face, the pressure difference being transferred from inside to outside via the through openings;

a second fluid passage being formed between the respective component and the outer surface, through which the first fluid passage is connected with the flow-disturbing face via the through openings, the first fluid path is greater than a path which is defined by the corresponding second fluid passage to facilitate transfer of the pressure difference;

wherein a width of the first fluid passage is determined by a thickness of the support pad.

2. The clothing according to claim 1, wherein the flow-disturbing face is formed as a concave-convex shape.

3. The clothing according to claim 2, wherein the concave-convex shape is one or more shapes selected from a group consisting of arc, triangle, zigzag, trapezoid, polygon and bar and the components are arranged in a uniform or non-uniform manner along longitudinal direction or lateral direction, thereby forming a water-wave flow disturbing face as a whole.

4. The clothing according to claim 1, further comprising a connecting piece, through which the components having flow-disturbing face being attached to the outer surface, a flexible connection or fixed connection between the connecting piece and the outer surface allowing the flow-disturbing face of respective component to cover the outer surface.

5. The clothing according to claim 4, wherein the through opening is arranged at a part of the outer surface where the part is covered by the flow-disturbing face, and is stayed away from the position where the connecting piece is connected to the outer surface; and a material which can be controlled through mechanical or optoelectronic means is provided in the connecting piece to control thickness and orientation of the connecting piece.

6. The clothing according to claim 1, wherein the component is a fish-scale flow disturbing piece, the forepart thereof is smaller than the rear thereof, the middle part of the outer surface thereof is protruded and smoothly extended downward to both sides to form a carved face as a flow-disturbing face, the radian of the outer surface thereof is larger than that of the inner surface.

7. The clothing according to claim 1, wherein the component is a feather-like flow disturbing piece having a trunk and several limbs smoothly extended downward s along both sides of the backbone, each limb has a branch and several sub-branches smoothly extended downward along both sides of the branch, the middle part of each sub-branch is protruded and smoothly extended downward to both sides to form a carved face, the entire outer surface of the feather-like flow disturbing piece is formed as a flow-disturbing face, the radian of the outer surface thereof is larger than that of the inner surface.

8. The clothing according to claim 1, wherein the components are arranged into one or more rows which are contacted with each other or partially overlapped.

9. The clothing article having a structure according to claim 1, wherein the clothing article being a headgear or footwear.

10. The clothing according to claim 1, wherein the thickness of the supporting pad is adjustable thereby enabling adjustment of the pressure.

* * * * *